United States Patent [19]

Ishida

[11] Patent Number: 4,594,307

[45] Date of Patent: Jun. 10, 1986

[54] COLOR THERMAL DIFFUSION-TRANSFER WITH LEUCO DYE REDUCING AGENT

[75] Inventor: Takuzo Ishida, Woodbury, Minn.

[73] Assignee: Minnesota Mining and Manufacturing Company, St. Paul, Minn.

[21] Appl. No.: 727,393

[22] Filed: Apr. 25, 1985

[51] Int. Cl.[4] ..... G03C 1/40; G03C 5/54

[52] U.S. Cl. ..... 430/203; 430/201; 430/213; 430/259

[58] Field of Search ..... 430/203, 201, 213

[56] References Cited

U.S. PATENT DOCUMENTS

| | | | |
|---|---|---|---|
| 3,457,075 | 7/1969 | Morgan et al. | 96/67 |
| 3,531,286 | 9/1970 | Renfrew et al. | 430/351 |
| 3,839,049 | 10/1974 | Simons | 96/114.6 |
| 3,985,565 | 10/1976 | Gabrilsen et al. | 430/203 |
| 4,021,240 | 6/1977 | Cerquone et al. | 430/203 |
| 4,022,617 | 5/1977 | McGuckin | 430/203 |
| 4,187,108 | 2/1980 | Willis | 430/203 |
| 4,235,957 | 11/1980 | Kohrt et al. | 430/203 |
| 4,260,677 | 4/1981 | Winslow et al. | 430/618 |
| 4,374,921 | 2/1983 | Frenchik | 430/338 |
| 4,426,441 | 1/1984 | Adin et al. | 430/351 |
| 4,430,415 | 2/1984 | Aono et al. | 430/203 |
| 4,455,363 | 6/1984 | Naito et al. | 430/203 |
| 4,459,346 | 7/1984 | Bishop et al. | 430/215 |
| 4,460,681 | 7/1984 | Frenchik | 430/502 |
| 4,463,079 | 7/1984 | Naito et al. | 430/203 |
| 4,478,927 | 10/1984 | Naito et al. | 430/203 |
| 4,499,172 | 2/1985 | Hirai et al. | 430/203 |
| 4,499,180 | 2/1985 | Hirai et al. | 430/559 |
| 4,503,137 | 3/1985 | Sawada | 430/203 |
| 4,507,380 | 3/1985 | Naito et al. | 430/203 |

FOREIGN PATENT DOCUMENTS 595239 7/1982 Japan .

*Primary Examiner*—Richard L. Schilling

*Attorney, Agent, or Firm*—Donald M. Sell; James A. Smith; Lorraine R. Sherman

[57] ABSTRACT

A photothermographic composite structure and process for its use provides a color image by thermal diffusion. The photothermographic composite structure comprises:

(a) an image-receiving element comprising a polymeric image-receiving layer having a glass transition temperature in the range of 20° to 200° C., and (b) strippably adhered to the image-receiving element, an imageable photothermographic element comprising in at least one layer, thereof a binder, a silver source material, photosensitive silver halide in catalytic proximity to the silver source material, if necessary a reducing agent for silver ion, and a leuco base dye.

26 Claims, No Drawings

COLOR THERMAL DIFFUSION-TRANSFER WITH LEUCO DYE REDUCING AGENT

TECHNICAL FIELD

The present invention relates to a photothermographic imaging element of the dry silver type for providing a color image by diffusion-transfer. In another aspect a process for providing a color image by thermal diffusion-transfer is disclosed.

BACKGROUND ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as a latent image. This latent image generally is not visible by ordinary means and the light sensitive article must be further processed in order to produce a visual image. The visual image is produced by the catalytic reduction of silver ions which are in catalytic proximity to the specks of the latent image.

As the visible image is produced entirely by silver, one cannot readily decrease the amount of silver in the emulsion without reducing the available maximum image density. Reduction of the amount of silver is desirable in order to reduce the cost of raw materials used in the emulsion.

One traditional way of attempting to increase the image density of photographic and photothermographic emulsions without increasing or while decreasing the amount of silver in the emulsion layer is by the addition of dye forming materials into the emulsion. In this way a dye enhanced silver image can be produced, as for example in U.S. Pat. Nos. 3,531,286, 4,187,108, 4,426,441, 4,374,921 and 4,460,681.

It has been described in the patent literature to transfer a dye image formed in a photothermographic system by means of a transfer solvent as is disclosed, for example, in U.S. Pat. Nos. 3,985,565, 4,021,240, 4,022,617, 4,430,415, 4,463,079, 4,455,363, 4,499,172, 4,499,180, and 4,503,137.

Japanese Kokai No. 59-5239 discloses a photothermographic contact diffusion system wherein a chemical reaction occurs in an image receiving layer between a diffused leuco dye and an acidic color developing agent.

SUMMARY OF THE INVENTION

Briefly, the present invention provides a photothermographic composite structure comprising:

(a) an image-receiving element comprising a polymeric image-receiving layer having a glass transition temperature in the range of 20° to 200° C., and (b) strippably adhered to the image-receiving element, an imageable photothermographic element comprising in at least one layer, thereof a binder, a silver source material, photosensitive silver halide in catalytic proximity to the silver source material, if necessary a reducing agent for silver ion, and a leuco base dye.

The present invention makes possible a silver-free colored dye image reproduction by a dye thermal diffusion-transfer process without use of chemicals, solvents, or post-treatments to aid in the transfer process. A diffusable dye image is formed by a photothermographic reaction in a heat-developable, photosensitive layer(s) containing at least one leuco base dye, an organic silver salt, a photocatalyst and preferably developer modifier(s), and can be diffusion-transferred into a dyeable, polymeric, image-receiving layer which is coated or placed in intimate contact adjacent to the heat developable photosensitive layer(s). Only heat is required in the transfer process.

The heat-developable, photosensitive layer(s) of the invention can be strippably adhered to the image-receiving layer on the same substrate to form a single composite structure, or, in another embodiment, the heat-developable, photosensitive layer(s) is separately coated on a different (or second) substrate from that of the image-receiving element. In the latter embodiment, the image-receiving layer of the image-receiving element and the exposed photosensitive layer of the photothermographic element are placed in intimate contact with each other (i.e. pressed together in a two-sheet assemblage) before development of the image. Subsequently, the imaged photothermographic element is stripped away from the receiving layer with its dye image.

In the present invention each of the elements (the photothermographic and image-receiving) may, independently and optionally, be adhered to a support. Preferably, the support comprises a polymeric resin which is chosen to require no adhesive for the element to adhere to a support, although an adhesive may be used.

In every case, it is required that the latent image-bearing and the image-receiving layers be in intimate face-to-face contact with each other during development of the image. Exposure can be through either the image-receiving element or the photothermographic element. For this to be possible, at least one of the elements and its support, when present, must be transparent.

After imagewise exposure and subsequent heat development and simultaneous thermal diffusion-transfer of the dye into the image-receiving layer, the photosensitive layer(s) which contain a reduced silver image is dry-stripped away from the image-receiving layer to provide a pure and clear dye image not contaminated with the reduced metallic silver image on the image-receiving layer.

No solvents are used in the diffusion-transfer process and the present invention method requires no color coupler or other chemicals in the image receiving layer to provide the dye image.

In the present invention:

"strippably adhered" means, as is well understood in the art, that the layers are sufficiently well adhered to each other to survive mild handling without the layers separating and yet still be separable from each other by hand when required. This generally means that a peel force (delaminating resistance) of about 1 to 50 g/cm width (0.1 to 4.5 ounces per inch width) of layer is needed to separate the two layers when one layer is pulled at 180° from the other at about 127 mm (5 inches) per minute. Preferably this peel force is in the range of 1 to 20 g/cm width (0.1 to 1.8 ounces per inch width);

"layer strength" means the downstrip stress on a layer (without substrate) that just tears the layer when a weight is applied thereto, the weight being increased to the point where it tears the layer;

"delaminating resistance" means the force needed to separate a layer from a substrate;

"leuco base dye" means a colorless or lightly colored dye which upon oxidation is converted to a colored dye form; and "actinic radiation" means infrared, visible, ultraviolet, x-ray, and electron beam.

In the prior art, dye-containing photothermographic systems provided turbid and hazy color images due to contamination with the reduced metallic silver image on the exposed area of the material after heat development. The resulting print tended to show background stain caused by aging during storage due to chemical reactants which remained in the material.

The present invention eliminates these disadvantages by thermally diffusion-transferring the silver-free dye image in a solvent-free process to a polymeric image-receiving layer which is coated or laminated adjacent to the heat-developable photosensitive layer.

DETAILED DESCRIPTION

The present invention provides a photothermographic composite structure comprising (1) a dyeable image-receiving element comprising a polymeric image-receiving layer having a glass transition temperature in the range of 20° to 200° C., which image-receiving layer is optionally adhered to at least one surface of a support, and (2) strippably adhered to the polymeric image-receiving layer, an imageable photothermographic element comprising, in at least one imageable layer thereof a binder, a silver source material, photosensitive silver halide in catalytic proximity to the silver source material, a leuco base dye, and optionally a reducing agent for silver ion, the photothermographic element having a delaminating resistance of 1 to 50 g/cm and a layer strength greater than, and preferably at least two times greater than, its delaminating resistance, which imageable layer(s) is optionally adhered to a support.

When the heat-developable, imageable, color photothermographic construction of the invention is imagewise exposed to actinic radiation and then heat-developed, an oxidation-reduction reaction occurs between the organic silver salt and the leuco base dye by means of an exposed light sensitive silver halide as a catalyst. Accordingly, a reduced silver image and an oxidized dye image are simultaneously formed in the light-exposed area of the material. The oxidized dye image can be thermally diffusion-transferred to an image-receiving layer. The thermal development of the dye image and the thermal diffision-transfer of the dye to the image-receiving layer occurs simultaneously without use of any post-treatment, chemicals, or transfer solvents.

After the heat-development, the heat-developable photosensitive element containing the reduced metallic silver image and other chemical reactants can be peeled apart from the dye-bearing image-receiving layer. A pure and stable dye image is obtained on the image-receiving layer.

The imageable photothermographic element of the present invention can be a unitary layer or it can comprise two or more layers as is well known in the art.

The optional support bases or substrates of the photothermographic imageable element of the invention as well as of the image-receiving element can be any supporting material such as paper, polymeric (plastic) film, glass, or metal. At least one of the imageable and image-receiving elements must be flexible and at least one must be transparent to allow for imaging and stripping functions. Transparent or opaque polymeric films are particularly useful. Preferably, the support comprises a thermoplastic resin which is useful as the polymeric image-receiving layer, e.g., polyesters such as polyethylene or poly(ethylene terephthalate); cellulosics such as cellulose acetate, cellulose butyrate, cellulose acetate butyrate, cellulose propionate, cellulose acetate propionate; polyolefins such as polystyrene; polyvinyl resins such as polyvinylchloride and polyvinylacetate; copolymeric vinyl resins such as copolymer of vinylchloride-vinylacetate, copolymer of vinylidene chloride-acrylonitrile, and copolymer of styrene-acrylonitrile. This eliminates an additional preparation (or coating) of the image-receiving layer. Combinations of resins (binders) are also useful.

The leuco base dye, which can be present in the photosensitive layer or in an adjacent layer, can be any colorless or lightly colored compound which can be oxidized to a colored form and which when heated to a temperature in the range of 80° to 250° C. (176° to 482° F.) for a time period of 0.5 to 300 seconds diffuses into the thermoplastic resin-containing receiving layer of the invention. Any leuco dye capable of being oxidized by silver ion to form a visible image is useful in the present invention. Compounds which are both pH sensitive and oxidizable to a colored state are useful but not preferred, while compounds only sensitive to changes in pH are not included within the term "leuco dyes" or "leuco base dyes" since they are not oxidizable to a colored form. Representatives classes of leuco dyes of the present invention include, but are not limited to, biphenol leuco dyes, phenolic leuco dyes, indoaniline leuco dyes, acylated azine leuco dyes, phenoxazine leuco dyes, and phenothiazine leuco dyes. Also useful are leuco dyes such as those disclosed in U.S. Pat. Nos. 3,445,234; 4,021,250; 4,022,617 and 4,368,247. The dyes listed in Japanese Kohyo National Publication No. 500352/82, published Feb. 25, 1982 are useful. Preferred dyes are described in U.S. Pat. No. 4,460,681, and are incorporated herein by reference. The dye image density and even color of the dye image in the polymer image-receiving layer is very much dependent on the polymer resin, which as mentioned above acts as a dye mordant and as such is capable of absorbing and fixing the dyes. A dye image having a reflection optical density in the range of 0.3 to 3.5 (preferably 1.5 to 3.5) or a transmission optical density in the range of 0.2 to 2.5 (preferably 1.0 to 2.5) can be achieved by the dye image in the present invention. The leuco dye can be present in the imageable photothermographic layer(s) in the range of 1 to 20 weight percent, preferably 3 to 15 weight percent.

The silver source material, as mentioned above, may be any material which contains a reducible source of silver ions. Silver salts of organic acids, particularly long chain (10 to 30, preferably 15 to 28, carbon atoms) fatty carboxylic acids are preferred. Complexes of organic or inorganic silver salts wherein the ligand has a gross stability constant for silver ion of between 4.0 and 10.0 are also desirable. The silver source material should constitute from about 7 to 70 percent by weight of the heat-developable, photosensitive layer(s).

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.01 to 15 percent by weight of the heat-developable, photosensitive layer, although larger amounts up to 20 or 25 percent are useful. It is preferred to use from 0.1 to 10 percent by weight silver halide in the heat-developable, photosensitive layer and most preferred to use from 0.1 to 2.0 percent. The silver halide used in the invention can be chemically and spectrally sensitized in a manner similar to the conventional wet process silver halide or state-of-the-art heat-developable photographic materials.

A reducing agent for silver ion besides the leuco base dye is not essential to the construction, but can be added into the heat-developable photosensitive layers(s) as an accelerator of the development rate, if necessary. When present, the preferred reducing agent (developer) for silver ion used in the present invention is a biphenol derivative or a triarylimidazone which will reduce silver ion to metallic silver and produce a colored quinone. Conventional photographic developers such as phenidone, hydroquinones, and catechol are useful in minor amounts, and hindered phenol reducing agents may also be added. The reducing agent should be present as 0.1 to 10 percent by weight of the imaging layer. In a two-layer construction, if the reducing agent is in the second layer, slightly higher proportions, of from about 0.1 to 15 percent, tend to be more desirable.

To modify the development rate or color, development modifiers, present in a range of 0.01 to 10 weight percent of the coating solution can be used. Representative development modifiers include aromatic carboxylic acids and their anhydrides such as phthalic acid, 1,2,4-benzenetricarboxylic acid, 2,3-naphthalene dicarboxylic acid, tetrachlorophathalic acid, 4-methyl phthalic acid, homophthalic acid, 4-nitro phthalic acid, o-phenylacetic acid, naphthoic acid, naphthalic acid, phthalic anhydride, naphthalic anhydride, tetrachlorophthalic anhydride, and the like.

Toners such as phthalazinone, and both phthalazine and phthalic acid, or derivatives thereof and others known in the art, are not essential to the construction, but are highly desirable. These materials may be present, for example, in amounts of from 0.01 to 10 percent by weight.

The binder for the silver coating is selected from well-known natural and synthetic resins such as gelatin, polyvinyl acetals, polyvinyl chloride, polyvinyl acetate, cellulose acetate, ethyl cellulose, polyolefins, polyesters, polystyrene, polyacrylonitrile, polycarbonates, methacrylate copolymers, maleic anhydride ester copolymers, and butadiene-styrene copolymers, and the like. When simultaneous coating of layers is used, the binder is selected to coordinate with the solvent used. Copolymers and terpolymers which include the above-stated binders are of course included in these definitions. The preferred photothermographic silver containing binder is polyvinyl butyral. The binders are generally used in a range of from 10 to 75 percent by weight of each layer, and preferably about 30 to 55 percent by weight.

The photothermographic element can also include coating additives to improve the strippability of the imaged layer, e.g., fluoroaliphatic polyesters dissolved in ethyl acetate (Fluorad TM FC 431, 3M, St. Paul, MN) can be added in an amount in the range of 0.02 to 0.5 weight percent of the imageable layer, preferably 0.1 to 0.3 weight percent. Alternatively, a coating additive to enhance strippability can be added to the image-receiving layer in the same weight range. No solvents are used in the stripping process. The strippable layer has a delaminating resistance of 1 to 50 g/cm and a layer strength greater than, and preferably at least two times greater than, its delaminating resistance.

Selection of the polymeric resin and solvent used in coating the photosensitive layer is a significant factor in determining strippability of the image-receiving layer. Preferably the polymeric resin in the image-receiving layer is impermeable to the solvent used for the heat-developable photosensitive emulsion and incompatible with the binder polymer used for the emulsion. The combination of such polymers and solvents results in poor adhesion to each other and provides good strippability.

The dyeable image-receiving layer of the invention is any flexible or rigid, transparent (optically clear) thermoplastic resin-containing layer, having a thickness of at least 0.1 micrometer, preferably in the range of 1 to 10 micrometers, and a glass transition temperature in the range of 20° to 200° C. In the present invention any thermoplastic resin or combination of resins can be used provided it is capable of absorbing and fixing the dye. The resin acts as a dye mordant. No additional fixing agents are required. Preferred polymeric thermoplastic resins that can be used in the image-receiving layer include polyesters such as polyethylene and polyethylene terephthalates, cellulosics such as cellulose acetate, cellulose butyrate, cellulose propionate, polystryene, polyvinylchloride, polyvinylacetate, copolymer of vinylchloride-vinylacetate, copolymer of vinylidene chloride-acrylonitrile, and copolymer of styrene-acrylonitrile.

The dyeable image-receiving element can consist of at least one of the above-mentioned thermoplastic resins, or the image-receiving layer can comprise the thermoplastic resin dissolved in an organic solvent (e.g., methyl ethyl ketone, acetone, tetrahydrofuran) and applied to the support base or substrate by various coating methods known in the art, such as curtain coating, extrusion coating, dip coating, air-knife coating, hopper coating and any other coating method used for solution coating. After coating the image-receiving element is dried (e.g., in an oven) to drive off the solvent.

Preferably, the image-receiving layer is coated adjacent to the heat-developable photosensitive layer. This facilitates diffusion-transfer of the colored dye (oxidized leuco dye) which is formed when the image-wise developable, photosensitive layer is subject to thermal treatment, for example, in a heated shoe and roller type heat processor, as is used in the art. In another embodiment, the dye formed in the heat-developable photosensitive layer can be thermally transferred into a separately coated image-receiving sheet by placing the exposed heat-developable photosensitive layer in intimate face-to-face contact with the image-receiving sheet and heating the resulting composite construction. Good results are achieved in this second embodiment when uniform contact for a time period in the range of 0.5 to 300 seconds between the layers exists during the thermal treatment (in the range of 80° to 220° C.).

The present invention also provides multi-color images prepared by superimposing in register, imaged-receiving layers as prepared above. Such an article requires that the resins of the individual images-receiving layers be sufficiently adherent to provide useful full color reproduction on a single substrate.

Advantages of the heat-developable color photographic material provided by this invention include preparation of pure, clear, and stable dye images at high photographic speed, as well as low silver requirement.

The material by this invention can be applied, for example, in conventional color photography, in electronically generated color hard copy recording and in digital color proofing for the graphic arts area because of high photographic speed, the pure dye images produced, and the dry and rapid process provided.

Objects and advantages of this invention are further illustrated by the following examples, but the particular materials and amounts thereof recited in these examples, as well as other conditions and details, should not be construed to unduly limit this invention. All percents are by weight unless otherwise indicated.

EXAMPLE 1

A fifteen percent solution of copolymer of vinylidene chloride-acrylonitrile (Saran F-310 TM, Dow Chemical Co., Midland, MI) in methyl ethyl ketone and acetone was coated at a wet thickness of 0.08 micrometer (3 mils) onto a $TiO_2$ filled polyester film as the image-receiving layer and dried at 78° C. (172° F.) in an oven for five minutes.

A dispersion of silver behenate half soap was made at 10% solids in toluene by homogenization. This dispersion is then prepared for coating by the addition of more solvent, halide, resin and sensitizing dye in a selected sequence of time and mixing. 127 g of the 10 percent silver soap dispersion was diluted with 324 g of toluene. Then 0.2 g of polyvinylbutyral was added. 12 cc of calcium bromide (2.1 g in 100 cc of methanol) was added with stirring. An additional 45 g of polyvinylbutyral was added three hours later. 2 cc of green sensitizing dye MSD 534 disclosed in U.S. Pat. No. 4,476,220 having the formula

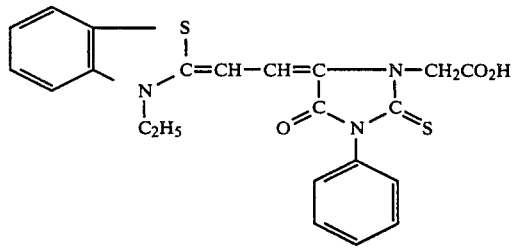

(0.025 g in 100 cc of methanol) was added into 50 g of the resulting dispersion. This dispersion was coated at a wet thickness of 0.08 micrometer (3 mils) over the image-receiving layer and dried at 78° C. (172° F.) in an oven for 5 minutes.

Two different topcoat solutions having the following composition were coated at a wet thickness of 0.08 micrometer (3 mils) over the silver coating and dried at 78° C. (172° F.) in an oven for 5 minutes.

| Component | Amount Topcoat A | Amount Topcoat B |
|---|---|---|
| toluene | 15 cc | 15 cc |
| ethanol | 12 cc | 12 cc |
| leuco-base dye | 0.26 g | 0.26 g |
| phthalic acid | 0.3 g | — |
| phthalazine | 0.06 g | — |
| phthalazinone | — | 0.1 g |
| 33 percent copolymer of methyl methacrylate in toluene | 25 g | 25 g |

The leuco-base dye, disclosed in U.S. Pat. No. 4,374,921 had the following formula:

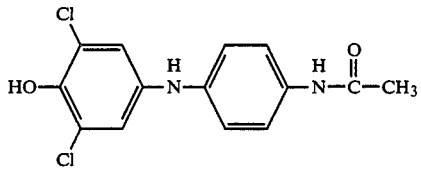

The resulting sheets were then exposed to an EG&G sensitometer (EG&G, Inc., Salem, MA) through a Wratten 58 green color separation filter for $10^{-3}$ seconds to produce a developable latent image in the heat developable photosensitive layer and heat-developed at 124° C. (255° F.) on a heat blanket for 40 seconds.

A turbid rust color image having a dye and silver image was formed on the light exposed area of the both sheets. The heat developable photosensitive layers having the reduced silver image were stripped off from the image-receiving layer.

A clear magenta dye was observed to have been transferred to the image-receiving layer corresponding to the negative silver image in the heat-developable photosensitive layer. The reflection density to green light was measured and the following sensitometric data was obtained from the samples:

| | Topcoat A | Topcoat B |
|---|---|---|
| Dmin | 0.11 | 0.11 |

-continued

| | Topcoat A | Topcoat B |
|---|---|---|
| Dmax | 0.60 | 0.60 |
| gamma angle | 42° | 29° |
| ergs/cm$^2$ at 0.4 density above Dmin | 13 | 25 |

EXAMPLE 2

0.25 g of the leuco-base dye, which is the same as used in Example 1, was added into 25 g of the 25 percent solution of copolymer of vinylidenechloride-acrylonitrile (Saran F-310) in methyl ethyl ketone and acetone and dissolved. This solution was coated onto a $TiO_2$ filled polyester film at a wet thickness of 0.08 micrometer (3 mils) and dried at 78° C. (172° F.) in an oven for 5 minutes.

The heat-developable photosensitive solution was prepared and applied over the above layer in the same manner as described in Example 1.

The topcoat solution, which has the same ingredients as Topcoat A in Example 1, but without a leuco base dye was coated over the silver coating layer in the same manner as described in Example 1.

The resulting sheets were then exposed to an EG&G sensitometer through a Wratten 58 green color separation filter for $10^{-3}$ seconds and heat-developed at 124° C. (255° F.) on a heat blanket for 40 seconds. A turbid rust color image was formed on the exposed area. Then the silver coating layer along with the topcoat layer was stripped off from the resin subcoated layer. A clear magenta dye image was obtained on the resin layer. The reflection density to green light was measured and the following sensitometric data was obtained from the sample:

| | |
|---|---|
| Dmin | 0.14 |
| Dmax | 0.60 |
| gamma angle | 24° |
| ergs/cm$^2$ at 0.4 density above Dmin | 66 |

EXAMPLE 3

The image-receiving layer and the silver coating layer were prepared in the same manner as described in Example 1.

The topcoat solution was formulated by adding 0.5 g of a leuco base dye (2,6,2',6'-tetramethyl biphenol) having the following formula:

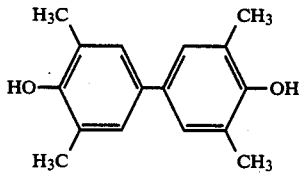

to 0.04 g of phthalic acid, 0.08 g of 4-methyl phthalic acid and 0.15 g of phthalazine to 17 cc of methanol. These ingredients were dissolved with stirring.

To this solution was added 35 g of a mixture resin of 75 parts of 10 percent polyvinyl pyrrolidone in methanol and 25 parts of 25 percent alkyl monoester of poly(methyl vinyl ether/maleic acid) in ethanol. The above topcoat solution was coated over the silver coating at a wet thickness of 0.08 micrometer (3 mils) and dried at 78° C. (172° F.) in an oven for 5 minutes.

The resulting greenish-color image was formed on the exposed area of the sheet. The silver coating layer along with the topcoat layer was stripped off from the image-receiving layer. A very bright yellow dye image was obtained on the image-receiving layer. The reflection density to blue light was measured and the following sensitometric data was obtained from the sample:

| | |
|---|---|
| Dmin | 0.12 |
| Dmax | 1.09 |
| gamma angle | 68° |
| ergs/cm$^2$ at 0.6 density above Dmin | 9 |

EXAMPLE 4

The image-receiving layer and the silver coating layer were prepared in the same manner as described in Example 1. The topcoat solution was also prepared in the same manner as described in Example 3, except the leuco-base dye. 6,6'-di-tert-butyl-4-4'-bi-O-cresol (AM-25 TM, Ethyl Corp., Ferndale, MI), having the following formula, was used as the leuco-base dye:

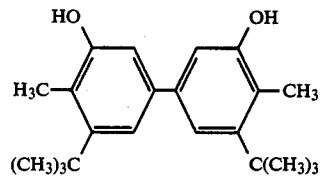

The topcoat solution was coated over the silver coating at a wet thickness of 0.08 micrometer (3 mils) and dried at 78° C. (172° F.) in an oven for 5 minutes. The resulting sheets were then exposed to an EG&G sensitometer through a Wratten 58 green color separation filter and heat-developed at 124° C. (255° F.) on a heat blanket for 40 seconds. The silver coating layer, along with the topcoat layer, was stripped off from the image-receiving layer. A clear yellow dye image was obtained on the image-receiving layer. The reflection density to blue light was measured and the following densities were obtained from the sample:

Dmin: 0.15

Dmax: 0.53.

EXAMPLE 5

A 15 percent solution of copolymer of polyvinylchloride-vinylacetate (Tg 79° C., Bakelite VYNS TM, Union Carbide Corp., NY, NY) in methyl ethyl ketone was coated at a wet thickness of 0.08 micrometer (3 mils) onto a vesicular opaque polyester film and dried at 91° C. (195° F.) in an oven for 5 minutes.

The silver coating solution was prepared in the same manner as described in Example 1 except for the sensitizing dye and the addition of a releasing agent. 2 cc of green sensitizing dye MSD 96 (disclosed in U.S. Pat. No. 4,476,220)

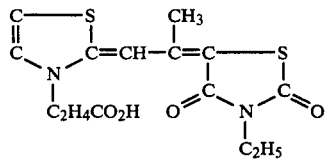

(0.02 g in 50 cc of methanol) and 5 drops of fluorocarbon coating additive FC 431 were added to 50 g of the silver dispersion. The resulting silver solution was coated over the image-receiving layer at a wet thickness of 0.05 micrometer (2 mils) and dried at 91° C. (195° F.) in an oven for 5 minutes. This silver coating gave 0.064 to 0.086 g/M$^2$ (6–8 mg per square foot) of silver.

A topcoat solution having the following composition was coated at a wet thickness of 3 mils over the silver coating and dried at 91° C. (195° F.) in an oven for 5 minutes.

| Component | Amount |
|---|---|
| toluene | 12 cc |
| ethanol | 7 cc |
| leuco-base dye (same in Example 1) | 0.26 g |
| phthalazinome | 0.05 g |
| tetrabromophthalic anhydride | 0.10 g |
| 20% solution of polystyrene resin in toluene | 34 g |

The resulting sheets were exposed to an EG&G sensitometer through a Wratten 58 green color separation filter for $10^{-3}$ seconds and heat-developed at 124° C. (255° F.) on a heat blanket for 5 seconds.

The silver coating layer along with the topcoat layer was then very smoothly stripped off from the image-receiving layer. The addition of the coating additive FC 431 made it very easy to peel the silver coating layer off from the image-receiving layer. A clear magenta dye image was obtained on the image-receiving layer.

The reflection density to green light was measured and the following sensitometric data was obtained from the sample:

| | |
|---|---|
| Dmin | 0.11 |
| Dmax | 0.52 |
| gamma angle | 25° |
| ergs/cm$^2$ at 0.2 density above Dmin | 52 |

EXAMPLE 6

A 15 percent solution of copolymer of vinylidene chloride-acrylonitrile (Saran F-310) in methyl ethyl ketone and acetone was coated at a wet thickness of 0.08 micrometer (3 mils) onto a vesicular opaque polyester film and dried at 78° C. (172° F.) for 5 minutes.

A dispersion of silver behenate half soap was made at 10% solids in ethanol by homogenization. 234 g of the silver half soap dispersion was diluted with 78 g of ethanol. Then 20 g of polyvinylbutyral was added. 5 cc of mercuric acetate (1.0 g in 25 cc of methanol) and 6 cc of calcium bromide (2.0 g in 50 cc of methanol) were added to the solution with stirring. An additonal 210 g of 10% solution of polyvinylbutyral in ethanol was added one hour later.

The heat-developable photosensitive solution was formulated by adding 0.2 g of syringaldazine (disclosed in Assignee's copending patent application U.S. Ser. No. 697,279, filed Feb. 1, 1985) having the following formula:

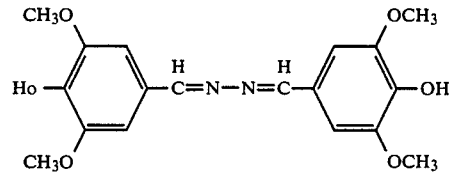

0.5 g of phthalazinone, 2 cc of green sensitizing dye RP 421 (disclosed in U.S. Pat. No. 4,336,323)

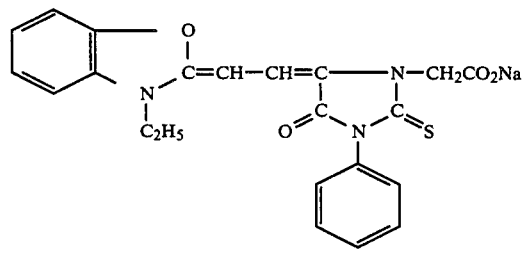

(0.02 g in 50 cc of methanol) and 3 drops of the 3M FC 431 to 50 g of the above silver soap dispersion.

The above silver solution was coated over the image-receiving layer at a wet thickness of 0.08 micrometer (3 mils) and dried at 78° C. (172° F.) in an oven for 5 minutes.

The resulting sheets were then exposed to an EG&G sensitometer through a Wratten 58 green color separation filter for $10^{-3}$ seconds and heat-developed at 124° C. (255° F.) on a heat blanket for 30 seconds. A turbid reddish dye image was formed on the exposed area of the material.

The heat-developable photosensitive layer was stripped off from the image-receiving layer. A very dense magenta dye image was obtained on the image-receiving layer. The reflection density to green light was measured and the following sensitometric data was obtained from the sample:

| | |
|---|---|
| Dmin | 0.09 |
| Dmax | 2.09 |
| gamma angle | 69° |
| ergs/cm$^2$ at 1.0 density above Dmin | 26 |

EXAMPLE 7

A 15 percent solution of copolymer of polyvinylchloride-vinylacetate (VYNS) in methyl ethyl ketone was coated as the image-receiving layer at a wet thickness of 0.08 micrometer (3 mils) onto a vesicular opaque polyester film and dried at 91° C. (195° F.) in an oven for 7 minutes. The copolymer of vinylchloride-vinylacetate had a Tg of 79° C.

The heat-developable photosensitive layer was prepared and coated over the image-receiving layer in the same manner as described in Example 6. The resulting sheets were then exposed to an EG&G sensitometer through a Wratten 58 green color separation filter for $10^{-3}$ seconds and heat-developed at 124° C. (255° F.) on a heat blanket for 25 seconds. The heat-developable photosensitive layer was stripped off from the image-receiving layer. A very dense and bright magenta dye image was obtained on the image-receiving layer. The reflection density to a green light was measured and the following sensitometric data were obtained from the sample.

| | |
|---|---|
| Dmin | 0.11 |
| Dmax | 2.33 |
| gamma angle | 62° |
| ergs/cm$^2$ at 1.0 density above Dmin | 27 |

EXAMPLE 8

The image-receiving sheet and the heat-developable photosensitive sheet were separately prepared in this experiment.

The image-receiving layer was prepared on the vesicular opaque polyester film in the same manner as described in Example 7.

The heat-developable photosensitive solution which was prepared in the same manner as described in Example 6 was coated onto the other substrate at a wet thickness of 0.08 micrometer (3 mils) and dried at 91° C. (195° F.) in an oven for 5 minutes.

The resulting heat-developable photosensitive sheet was imagewise exposed to light. The exposed heat-developable photosensitive layer was then placed in face-to-face contact with the image-receiving sheet, and the resulting sandwich was heated at 124° C. (255° F.) on a heat blanket for 30 seconds. The heat-developable photosensitive sheet was peeled apart from the image-receiving sheet. A clear magenta dye image was observed to have been transferred to the image-receiving sheet, corresponding to the negative silver image of the heat-developable photosensitive sheet. The reflection density to green light was measured and the following densities were obtained from the sample:

background density: 0.10,
image area density: 0.79.

EXAMPLE 9

The image-receiving sheet and the heat-developable photosensitive sheet were separately prepared in the same manner as described in Example 8.

The heat-developable photosensitive sheet was imagewise exposed to light and heat-developed at 124° C. (255° F.) on a heat blanket for 20 seconds.

A turbid magenta image having the reduced metallic silver image was formed on the exposed area. The print was then placed in face-to-face contact with the image-receiving sheet. The resulting composite was then exposed to an infrared light source by passing the composite through the 3M Thermo-Fax TM transparency maker for 6 seconds. The heat-developed photosensitive sheet was peeled apart from the image-receiving sheet. A clear magenta dye was obtained on the image-receiving sheet, corresponding to the image area of the heat-developable photosensitive sheet. The reflection density to green light was measured and the following densities were obtained from the sample:

background density: 0.10,
image area density: 0.45.

EXAMPLE 10

Two different image-receiving resins were prepared. One was a 15 percent solution of copolymer of vinylidene chloride-acrylonitrile (Saran F-310) in methyl ethyl ketone. Another was a 15 percent solution of copolymer of vinylchloride-vinylacetate (VYNS) in methyl ethyl ketone. Both resin solutions were separately coated onto a vesicular opaque polyester film as the image-receiving layer at a wet thickness of 0.08 micrometer of (3 mils) and dried at 91° C. (195° F.) in an oven for 5 minutes.

274 g of the 10 percent half soap dispersion was diluted with 159 g of ethanol and 159 g of methanol. Then 0.4 g of polyvinyl butyral was added and dissolved. 12 cc of mercury bromide (3.6 g in 100 cc of methanol) was added with stirring. An additional 48 g of polyvinylbutyral was added two hours later. 0.25 g of Pergascript Turquoise TM S-2G (Ciba Geigy)

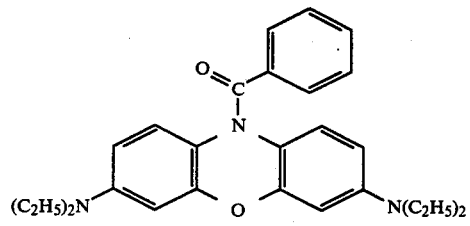

as a leuco-base dye, 2 cc of red sensitizing dye MSD563 (disclosed in U.S. Pat. No. 3,719,495) having the formula

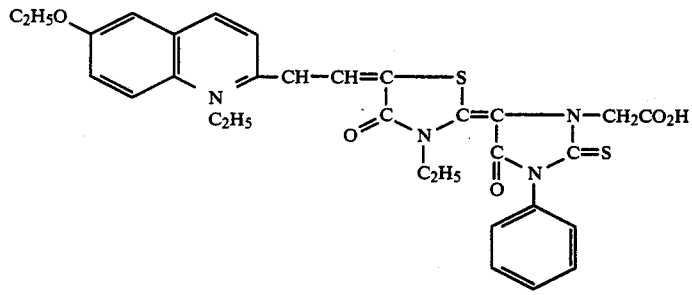

(0.02 g in 50 cc of methanol) and 3 drops of fluorocarbon coating additive Fluorad FC 431 were added to 25 g of the resulting silver dispersion and mixed.

This silver solution was coated over the above image-receiving layers at a wet thickness of 0.08 micrometer (3 mils) and dried at 91° C. (195° F.) in an oven for 5 minutes.

A topcoat solution was formulated by adding 15 cc of ethanol and 0.25 g of phthalic acid to 14 g of a 15 percent solution of cellulose acetate butyrate resin in ehtanol. This topcoat solution was coated over the silver coating layer at a wet thickness of 0.08 micrometer (3 mils) and dried at 91° C. (195° F.) in an oven for 5 minutes.

The resulting sheets were then exposed to an EG&G sensitometer through a Wratten 25 red color separation filter for $10^{-3}$ seconds and heat-developed at 124° C. (255° F.) on a heat blanket for 40 seconds.

A turbid bluish color image was formed on the exposed area of both materials. Then the silver coating layer, along with the topcoat layer was stripped off from the image-receiving layer. A very dense and bright cyan dye image was obtained on both image-receiving layers.

The reflection density to red light was measured and the following sensitometric data were obtained from the samples:

| | Image-Receiving Layer | |
|---|---|---|
| | Copolymer of vinylidene chloride-acrylonitrile | Copolymer of vinylchloride-vinylacetate |
| Dmin | 0.26 | 0.11 |
| Dmax | 3.30 | 2.82 |
| gamma angle | 73° | 70° |
| ergs/cm$^2$ at 1.0 density above Dmin | 63 | 64 |

The copolymer of vinylchloride-vinylacetate provided lower background stain.

EXAMPLE 11

A 15 percent solution of copolymer of vinylchloride-vinylacetate (Tg 72° C., Bakelite VYHH TM, Union Carbide) was coated onto a vesicular opaque polyester film at a wet thickness of 0.08 micrometer (3 mils) and dried at 91° C. (195° F.) in an oven for 7 minutes.

274 g of the 10 percent half soap dispersion in toluene was diluted with 318 g of toluene. Polyvinylbutyral (0.04 g) was added and dissolved. 5 cc of mercuric acetate (0.2 g in 100 cc of methanol) were added with stirring. An additional 38 g of polyvinylbutyral was added three hours later and dissolved. 2 cc of blue sensitizing dye RP 454 (disclosed in U.S. Pat. No. 4,123,282)

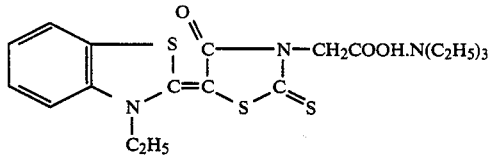

(0.02 g in 50 cc of methanol) and 5 drops of the fluorocarbon coating additive FC 431 were added to 50 g of the above silver dispersion. This silver solution was coated over the image-receiving layer at a wet thickness of 0.08 micrometer (3 mils) and dried at 91° C. (195° F.) in an oven for 5 minutes.

The topcoat solution was formulated by adding 1 g of 2,6,2′,6′-tetramethyl biphenol as a leuco-base dye, 0.2 g of phthalazine, 0.16 g of 4-methylphthalic acid, and 0.04 g of benzotriazole to 40 cc of methanol. To this solution was added 70 g of the resin mixture which was described in Example 3. This topcoat solution was coated over the silver coating layer at a wet thickness of 0.08 micrometer (3 mils) and dried at 91° C. (195° F.) in an oven for 5 minutes.

The resulting sheets were then exposed to an EG&G sensitometer through a Wratten 47 blue color separation filter for $10^{-3}$ seconds and heat-developed at 124° C. (255° F.) on a heat blanket for 30 seonds.

A turbid greenish yellow color image was formed on the exposed area of the sheet. The silver coating layer along with the topcoat layer was stripped off from the image-receiving layer. A very bright yellow dye image was obtained on the image-receiving layer. The reflection density to blue light was measured and the following sensitometric data was obtained from the sample:

| | |
|---|---|
| Dmin | 0.11 |
| Dmax | 1.29 |
| gamma angle | 61° |
| ergs/cm$^2$ at 1.0 density above Dmin | 33 |

EXAMPLE 12

Two different image-receiving resins were prepared and coated in the same manner as described in Example 10.

The silver coating solution and the topcoat solution were prepared and coated in the same manner as described in Example 5 except for the leuco-base dye. A leuco-base dye (method of preparation disclosed in U.S. Pat. No. 4,374,921) having the following formula was used in this trial:

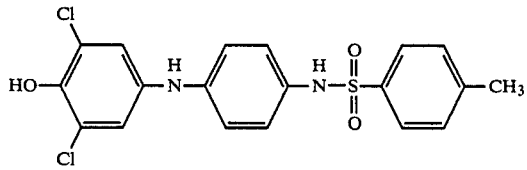

The resulting sheets were then exposed to an EG&G sensitometer through a Wratten 58 green color separation filter for $10^{-3}$ seconds and heat-developed at 124° C. (255° F.) on a heat blanket for 15 seconds.

A turbid rust color image was formed on the exposed area of both sheets. Then the silver coating layer was stripped off from the image-receiving layer. A clear magenta dye image was obtained on both image-receiving layers.

The reflection density to green light was measured and the following sensitometric data was obtained from the sample:

| | Image-Receiving Layer | |
|---|---|---|
| | Copolymer of vinylidene chloride-acrylonitrile | Copolymer of vinyl chloride-vinylacetate |
| Dmin | 0.15 | 0.11 |
| Dmax | 0.41 | 0.46 |
| gamma angle | 14° | 17° |
| ergs/cm$^2$ at 0.2 density above Dmin | 38 | 24 |

EXAMPLE 13

The image-receiving layer was prepared in the same manner as described in Example 11.

The silver coating solution was prepared in the same manner as described in Example 10 with the exception of the leuco-base dye. The following leuco-base dyes (prepared as disclosed in assignee's copending patent application U.S. Ser. No. 656,460, filed Oct. 1, 1984) were used in the trials:

Leuco Dye 1

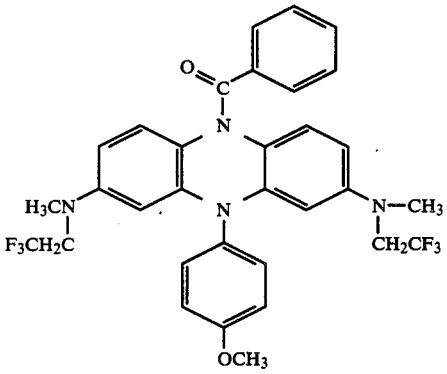

Leuco Dye 2

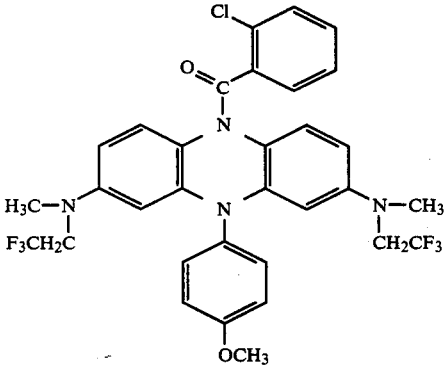

Leuco Dye 3

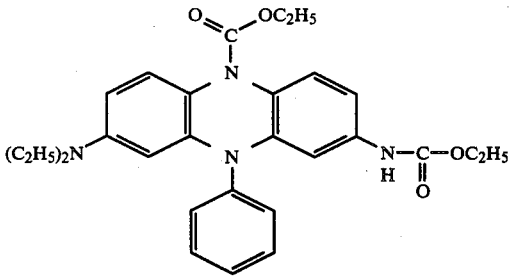

Leuco Dye 4

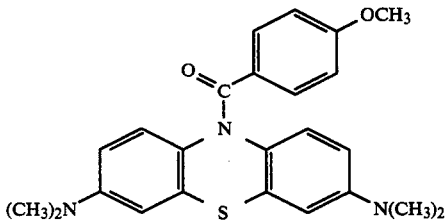

-continued

Leuco Dye 5

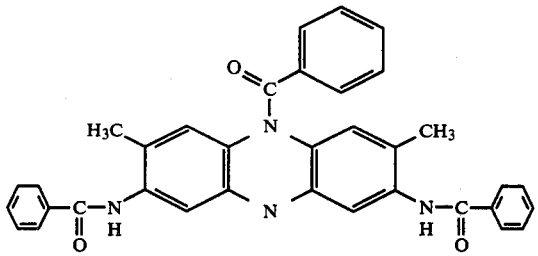

The topcoat solution was prepared and applied over the silver coating layer in the same manner as described in Example 10.

The resulting sheets were then imagewise exposed and heat-developed at 124° C. (255° F.) on a heat blanket for 20–60 seconds. The silver coating layer along with the topcoat layer was stripped off from the image-receiving layer.

Dye image having the following color and density was obtained on each image-receiving layer.

| Leuco dye | 1 | 2 | 3 | 4 | 5 |
|---|---|---|---|---|---|
| dye color | magenta | magenta | violet | cyan | yellow |
| filter used for densitometer | green | green | green | red | blue |
| Dmin | 0.10 | 0.08 | 0.07 | 0.08 | 0.06 |
| Dmax | 1.33 | 0.24 | 0.59 | 1.22 | 0.25 |

EXAMPLE 14

These trials were done to evaluate various substrates and resins as an image-receiving material.

| | |
|---|---|
| Sample 1 | vesicular opaque polyester film (Tg 69° C.) |
| Sample 2 | titanium dioxide filled polyester film (Tg 69° C.) |
| Sample 3 | copolymer of vinylchloride-vinylacetate on sample 1 (Tg 73° C., Bakelite VMCC TM, Union Carbide) |
| Sample 4 | copolymer of vinylchloride-vinylacetate on sample 1 (Tg 78° C., Bakelite VYLF TM, Union Carbide) |
| Sample 5 | copolymer of vinylchloride-vinylacetate on sample 1 (Tg 79° C., VYNS) |
| Sample 6 | copolymer of vinylchloride-vinylacetate on sample 1 (Tg 79° C., Bakelite VYNW TM, Union Carbide) |
| Sample 7 | copolymer of vinylidene chloride-acrylonitrile on sample 1 (Saran F-310) |
| Sample 8 | polyvinylacetate on sample 1 (Tg 28° C., Bakelite AYAF TM, Union Carbide) |
| Sample 9 | polyvinylchloride on sample 1 (Tg 81° C., PVC-166 TM, Dow Chemical Co., Midland, MI) |
| Sample 10 | polystyrene on sample 1 (Tg 100° C., Styron 685D TM, Dow Chemical Co.) |
| Sample 11 | copolymer of styrene-acrylonitrile on sample 1 (Tg 102° C., Tyril-867B TM, Dow Chemical Co.) |
| Sample 12 | cellulose acetate on sample 1 (Tg 182° C., E-398-6, Eastman Kodak Co., Rochester, NY) |
| Sample 13 | polyvinylbutyral on sample 1 (Tg 48° C., Butvar-B76 TM, Monsanto Co., St. Louis, MO) |
| Sample 14 | resin for sample 5 on sample 2 |
| Sample 15 | resin for sample 5 on baryta paper. |

The above copolymers of vinylchloride-vinylacetate from sample 3 to sample 6 vary the composition as follows:

| | Vinyl chloride | Vinyl acetate | Other |
|---|---|---|---|
| sample 3 | 83 | 16 | 1 |
| sample 4 | 88 | 12 | — |
| sample 5 | 90 | 10 | — |
| sample 6 | 97 | 3 | — |

A 15 percent solution of each resin was coated on the substrate as the image-receiving layer for samples 3 to 15 at a wet thickness of 0.08 micrometer (3 mils) and dried at 91° C. (195° F.) in an oven for 5 minutes.

The heat-developable photosensitive solution was prepared in the same manner as described in Example 6 and coated over the above substrate (sample 1 and 2) or the resin layer (samples 3 to 15) at a wet thickness of 0.08 micrometer (3 mils) and dried at 91° C. (195° F.) in an oven for 5 minutes.

The resulting sheets were then exposed to an EG&G sensitometer for $10^{-3}$ seconds and heat-developed at 124° C. (255° F.) on a heat blanket for 20 seconds.

The silver coating layer was stripped off from the substrate or the image-receiving layer. The reflection density of the dye obtained on the substrate or the resin layer was measured and the following densities were obtained from the samples:

| Sample # | Dmin | Dmax |
|---|---|---|
| 1 | 0.06 | 0.41 |
| 2 | 0.06 | 0.32 |
| 3 | 0.09 | 1.99 |
| 4 | 0.09 | 2.04 |
| 5 | 0.09 | 2.07 |
| 6 | 0.08 | 1.76 |
| 7 | 0.09 | 2.09 |
| 8 | 0.07 | 1.30 |
| 9 | 0.06 | 1.34 |
| 10 | 0.07 | 0.36 |
| 11 | 0.07 | 0.80 |
| 12 | 0.06 | 0.24 |
| 13 | 0.07 | 0.22 |
| 14 | 0.07 | 2.09 |
| 15 | 0.08 | 1.96 |

Polyvinylchloride, polyvinylacetate, copolymer of vinylchloride-vinylacetate, copolymer of vinylidene chloride-acrylonitrile and copolymer of styrene-acrylonitrile provided higher dye image density rather than an ordinary substrate, for instance, polyester film.

EXAMPLE 15

This trial was done to evaluate the effect of fluorocarbonate stripping agent [coating additive Fluorad FC 431 TM (3M)] on the strippability of photothermographic layer from the image-receiving layer.

The image-receiving resin solution was prepared and coated on the opaque polyester film in the same manner as described in Example 7.

The heat-developable photosensitive solution was formulated in the same manner as described in Example 6 except for the amount of stripping agent Fluorad FC 431.

| | 1 | 2 | 3 | 4 |
|---|---|---|---|---|
| emulsion | 25 g | 25 g | 25 g | 25 g |
| Fluorad FC 431 | — | 1 drop | 2 drops | 4 drops |

-continued

| | 1 | 2 | 3 | 4 |
|---|---|---|---|---|
| (g) | (—) | (0.016 g) | (0.031 g) | (0.063 g) |

The above solutions were coated over the image-receiving layer at a wet thickness of 0.08 micrometer (3 mils) and dried at 91° C. (195° F.) in an oven for 5 minutes.

The resulting sheets were then imagewise exposed to light and heat-developed at 124° C. (255° F.) on a heat blanket for 20 seconds. Then the removability of the photothermographic layer from the image-receiving layer was determined using an adhesive tape.

| | 1 | 2 | 3 | 4 |
|---|---|---|---|---|
| strippability of the photothermographic layer | no | yes, but the layer tends to tear | yes, and smoothly | yes, and smoothly |

The photothermographic layer which did not contain stripping agent Fluorad FC 431 could not be peeled apart from the image-receiving layer, but the photothermographic layer containing stripping agent Fluorad FC 431 was peeled apart from the image-receiving layer.

EXAMPLE 16

Samples of yellow, magenta, and cyan were prepared on a transparent polyester film in the same manner as described in Examples 11, 7, and 10 respectively, except the coating thickness of the silver solution. Each of the silver solutions was coated over the image-receiving layer of copolymer of vinylchloride-vinylacetate having the transparent polyester film at a wet thickness of 0.10 micrometer (4 mils) and dried at 91° C. (195° F.) in an oven for 5 minutes.

These resulting sheets were exposed to an EG&G sensitometer for $10^{-3}$ seconds and heat-developed at 124° C. (255° F.) on a heat blanket for 30 seconds. Then the heat-developable photosensitive layer of each sheet was stripped off from the image-receiving layer. The transmission densities of the dye formed on the image-receiving layer were measured through a filter having a complimentary color with respect to color of the dye, and the following Dmin and Dmax were obtained from each of these samples:

| | Dmin | Dmax |
|---|---|---|
| yellow | 0.04 | 0.80 |
| magenta | 0.04 | 1.35 |
| cyan | 0.04 | 2.12 |

Each of the heat-developable photosensitive sheets prepared in the same manner as described above was imagewise exposed through color separation negative film, respectively, and heat-developed at 124° C. (255° F.) on a heat blanket for 30 seconds. The heat-developable photosensitive layer of each sheet was stripped off from the image-receiving layer.

Three primary color sheets having a very clear dye image were thus made on the transparent polyester film. An excellent full color reproduction was obtained by overlaying these three primary color sheets.

EXAMPLE 17

Three primary color sheets having a very clear dye image were made on transparent polyester film in the same manner as described in Example 16.

A receptor sheet was prepared by coating an 8% solution of a copolymer of vinylchloride-vinylacetate (VYHH) onto an opaque polyester film at a wet thickness of 0.08 micrometer (3 mils) and drying it at 82° C. (180° F.) in an oven for 5 minutes.

The yellow sheet was laminated to the receptor sheet in a two hot roll laminator set at 132°/60° C. and the transparent polyester substrate of the yellow sheet was removed. The image receiving layer having yellow dye image was thus transferred to the receptor sheet.

Magenta and cyan layers were further laminated to the receptor sheet in like manner. An excellent full color reproduction was obtained on the receptor sheet.

EXAMPLE 18

A receptor sheet was prepared by coating an 8% solution of a copolymer of vinylchloride-vinylacetate (VYHH) onto a baryta paper at a wet thickness of 0.08 micrometer (3 mils) and drying it at 82° C. (180° F.) in an oven for 5 minutes.

Three primary color sheets on transparent polyester film were laminated to the resin primed baryta paper in the same manner as described in Example 17 in order of yellow, magenta and cyan. An excellent full color reproduction was obtained on the receptor sheet.

Various modifications and alterations of this invention will become apparent to those skilled in the art without departing from the scope and spirit of this invention, and it should be understood that this invention is not to be unduly limited to the illustrative embodiments set forth herein.

I claim:

1. A photothermographic composite structure for use in a solvent-free dye thermal diffusion-transfer process comprising:

(a) an image-receiving element comprising a polymeric dyeable image-receiving layer having a glass transition temperature in the range of 20° to 200° C., and (b) strippably adhered to said image-receiving element, an imageable photothermographic element comprising in at least one layer thereof a binder, a silver source material, photosensitive silver halide in catalytic proximity to said silver source material, and a leuco base dye as the sole reducing agent present.

2. The composite structure according to claim 1 wherein said photothermographic element further comprises a support.

3. The composite structure according to claim 1 wherein said image-receiving element further comprises a support.

4. The composite structure according to claim 2 wherein said support is paper, thermoplastic polymer, glass, or metal.

5. The composite structure according to claim 3 wherein said support is paper, thermoplastic polymer, glass, or metal.

6. The composite structure according to claim 1 wherein said leuco dye is a biphenol leuco dye, a phenolic leuco dye, an indoaniline leuco dye, an acylated azine leuco dye, a phenoxazine leuco dye, or a phenothiazine leuco dye.

7. The composite structure according to claim 1 wherein said image-receiving layer comprises a polymeric thermoplastic resin selected from the group consisting of polyesters, cellulosics, and polyolefins.

8. The composite structure according to claim 7 wherein said resin is a polyvinyl or copolymeric vinyl resin.

9. The composite structure according to claim 7 wherein said resin is polyvinyl acetate.

10. The composite structure according to claim 7 wherein said resin is polyvinylchloride.

11. The composite structure according to claim 7 wherein said resin is a copolymer of vinylchloride-vinylacetate.

12. The composite structure according to claim 7 wherein said resin is a copolymer of vinylidene chloride-acrylonitrile.

13. The composite structure according to claim 7 wherein said resin is a copolymer of styrene-acryonitrile.

14. The composite structure according to claim 1 wherein said photothermographic element further comprises a development modifier.

15. The composite structure according to claim 5 wherein said support is a polymeric thermoplastic resin.

16. The composite structure according to claim 1 wherein said photothermographic element further comprises a stripping agent.

17. The composite structure according to claim 16 wherein said stripping agent is a fluorocarbon compound.

18. A method of providing a color image comprising the steps:

(1) providing a photothermographic composite structure comprising:

(a) an image-receiving element comprising a dyeable polymeric image-receiving layer having a glass transition temperature in the range of 20° to 200° C., and (b) strippably adhered to said image-receiving element, a photosensitive, photothermographic element comprising in at least one layer thereof a binder, a silver source material, photosensitive silver halide in catalytic proximity to said silver source material, and a leuco base dye as the sole reducing agent present, (2) imagewise exposing said photosensitive element of said photothermographic structure to radiation to provide a latent silver image, (3) developing the exposed composite structure by uniformly heating said structure to form a diffusible dye and allowing it to transfer by diffusion without use of a solvent to said image-receiving layer, (4) dry-stripping said photothermographic element from said image-receiving element to provide a self-supported color image-containing element.

19. The method according to claim 18 wherein each of said image-receiving and said photothermographic elements independently further comprise a support.

20. The method according to claim 19 wherein said support is paper, polymeric thermoplastic resin, glass, or metal.

21. The method according to claim 20 wherein said support for said image-receiving layer is a polymeric thermoplastic resin.

22. The method according to claim 21 wherein said photothermographic element further comprises a stripping agent.

23. The method according to claim 18 wherein said step (1) for providing a composite photothermographic structure further comprises the steps of:

(a) providing an imageable photothermographic element comprising a photosensitive layer, (b) providing in a separate sheet, a dyeable image-receiving element comprising an image-receiving layer, (c) bringing said photosensitive layer and said image-receiving layer into intimate face-to-face contact so as to provide a composite photothermographic structure.

24. The method according to claim 18 wherein said heating and transfer step takes place at a temperature in the range of 80° to 250° C. for a time period in the range of 0.5 to 300 seconds.

25. The method according to claim 18 for providing a colored imaged article.

26. The method according to claim 18 for providing a multi-colored imaged article wherein two or more of said color imaged receiving layers are superimposed in register on a single substrate.

* * * * *